United States Patent [19]

Englert

[11] Patent Number: 4,880,136

[45] Date of Patent: Nov. 14, 1989

[54] CONTAINER CLOSURE

[76] Inventor: Nickolaus Englert, 51 Betula Avenue, Vermont, Victoria, 3133, Australia

[21] Appl. No.: 277,286

[22] Filed: Nov. 29, 1988

[30] Foreign Application Priority Data

Nov. 30, 1987 [AU] Australia ..... P15657

[51] Int. Cl.[4] ..... B65D 51/18

[52] U.S. Cl. ..... 220/253; 220/90.4; 220/90.6

[58] Field of Search ..... 220/90.2, 90.4, 90.6, 220/253, 336

[56] References Cited

U.S. PATENT DOCUMENTS

| | | | |
|---|---|---|---|
| 402,679 | 5/1889 | Leggett | 220/336 X |
| 3,169,679 | 2/1965 | Hunter | 220/336 X |
| 3,372,832 | 3/1968 | Yeater et al. | 220/90.4 X |
| 3,494,500 | 2/1970 | Foster | 220/269 |
| 3,826,400 | 7/1974 | Hougen et al. . | |
| 4,127,187 | 11/1974 | Smith | 206/219 |
| 4,170,724 | 10/1979 | Waterbury . | |
| 4,579,245 | 4/1986 | Narushko | 220/253 |
| 4,634,014 | 1/1987 | Carr | 220/90.4 X |
| 4,717,037 | 1/1988 | van der Meulen | 220/90.6 |
| 4,717,039 | 1/1988 | Ayyoubi | 220/253 |
| 4,738,373 | 4/1988 | De Parales | 220/90.4 X |
| 4,752,016 | 6/1988 | Eads | 220/253 |

FOREIGN PATENT DOCUMENTS 8622699 4/1987 Fed. Rep. of Germany .

*Primary Examiner*—Stephen Marcus
*Assistant Examiner*—Nova Stucker

[57] ABSTRACT

A safety closure in disclosed for use with containers, such as for beverage containers, including cans. The container closure comprises a flat disc member adapted to fit the end of a container of the type having an opening through which beverage can flow, the disc being rotatable about its central axis to align an opening thereon with the container end's opening, and a peripheral rib for assisting in locating and retaining the flat disc member in a desired position relative to the container end's opening.

1 Claim, 2 Drawing Sheets

CONTAINER CLOSURE

This invention relates to beverage container closures and refers particularly, though not exclusively, to closures for beverage cans.

Cans are extensively used for beverages. They are used indoors and, particularly, outdoors. The beverages in the can may be aerated, naturally sparkling, or still. They may be alcoholic or non-alcoholic.

Problems have arisen where the use of cans for beverages could be a danger to the consumer. The dangers are the European wasps and other pests. It has been known for pests such as, for example, European wasps to enter an opened beverage can after being attracted by the sweetness of the contents. Naturally, once inside, the wasp cannot be seen by a consumer. Upon the consumer taking a further drink directly from the can, the wasp may also be ingested by the consumer. The wasp would normally be caught in the throat where their natural tendency to sting would occur. As European wasps can sting repeatedly (and do so quite often) a great deal of swelling can take place in and around the throat. In the extreme, the throat may completely close and the person could die from asphyxiation.

It is therefore the principal object of the present invention to provide a means for closing a beverage container, at least temporarily, to prevent the unwanted ingress of contaminants and pests.

With the above and other objects in mind, the invention provides a container closure comprising a substantially flat disc adapted to fit on the container and having an opening therethrough, said disc being rotatable about its central axis to align said opening with an opening in said container such that further rotation causes said disc to cover said container opening; said disc having a depending peripheral rib to assist in locating and retaining said disc in position relative to said container; said disc having at least one lug projecting axially upwardly therefrom.

A preferred embodiment of the invention shall now be described by way of non-limitative example only and with reference to the accompanying illustrative drawings.

Figure 1:
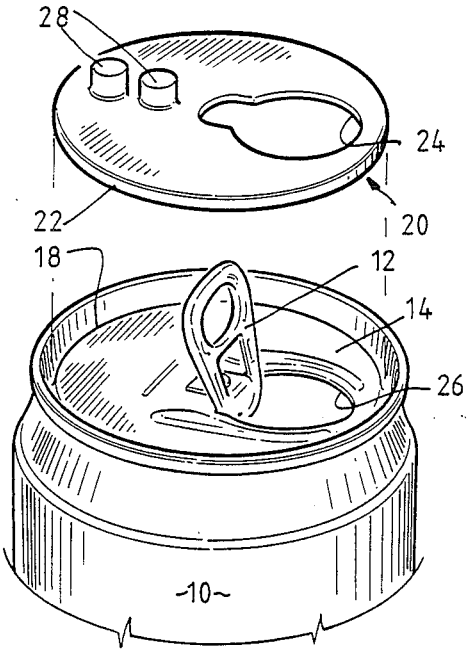
FIG. 1 is a top perspective view of the upper regions of a can, partially opened, showing an embodiment of the present invention prior to assembly.
Figure 2:
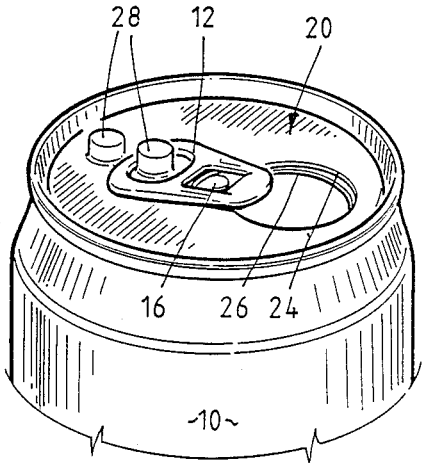
FIG. 2 is a top perspective view corresponding to that of FIG. 1 but after assembly.
Figure 3:
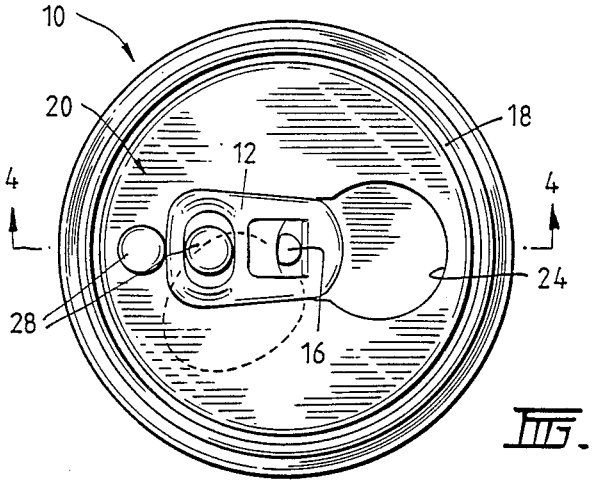
FIG. 3 is a top plan view of the assembly of FIG. 2 after rotation of the embodiment of the present invention.
Figure 4:
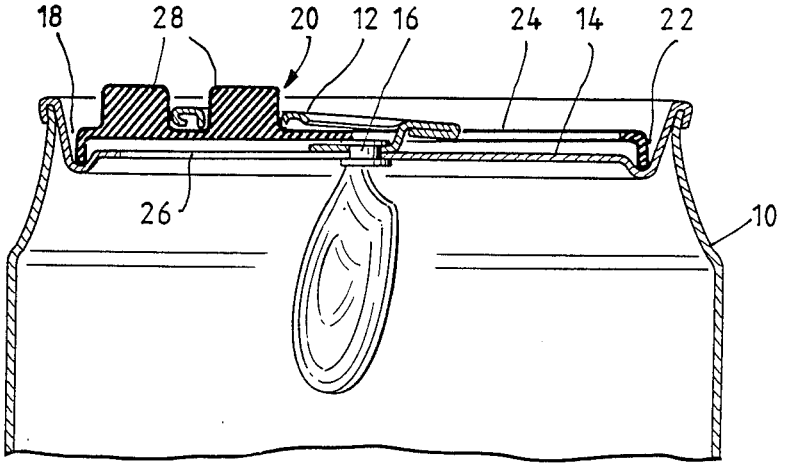
FIG. 4 is a vertical cross-sectional view along the lines of and in the direction of arrows 4—4 of FIG. 3.

The particular embodiment of FIGS. 1 to 5 is for use with cans, and in particular those cans normally used for beer, mixed drinks, and soft drinks. Some such cans have a ring which is lifted to enable the sealing can closure to be removed. The present invention can be used with such cans—hereinafter called the "ring pull" cans.

Another form of can has a tab which is lifted and pressed over to force the sealing can closure to be forced into the can but still being attached to the top. The present invention can be used with such cans—hereinafter called "lift tab" cans.

To refer now to the drawings, there is shown a lift tab can 10 having a tab 12 attached to the top 14 of the can 10 by a rivet 16. The top 14 has peripheral channel 18. There is provided a relatively flat disc 20 which is sized to fit onto the top 14 of cans 10, normally after it has been opened. Around the outer periphery of the disc 20 is a downwardly directly rib 22 which fits into channel 18 to help locate the disc 20 in the correct position, and to assist in its operation. The disc 20 has an opening 24 which is at least as large as the can opening 26. In addition, two axially upwardly directed lugs 28 are provided and which are able to be contacted or gripped by at least one finger of a user to enable the disc 20 to be rotated about its longitudinal axis.

In operation, the can 10 would first be opened by lifting tab 12 in the usual manner. The disc 20 would then be placed on the top 14 of the can 10 with its opening 24 aligned over the can opening 26.

The tab 12 remains attached to the can by the rivet 16. The tab 12 is passed through the disc opening 24 and pressed over the disc 20 to engage with the lugs 28 to assist in keeping the disc 20 in position and to hold the tab 12 out of the way. This lug may be provided with an undercut (not shown) to assist with this if desired.

It is now possible to dispense or drink the contents of can 10. The disc 20 can then be rotated about its longitudinal axis using the lugs 28 until the can opening 26 was covered (see FIG. 3). When it was next desired to dispense contents from the can 10, or to drink from the can 10, the disc 20 can again be rotated using the lugs 28 until the disc opening 24 was aligned over the can opening 26.

The disc 20 may be made of any suitable material such as, for example, a plastics material (e.g. nylon) or aluminium. It may be a separate, removable component as shown or may be integral with the can top. The disc 20 may be made as a complete, circular disc as shown or may be made as a segment of a circle.

Figure 5:
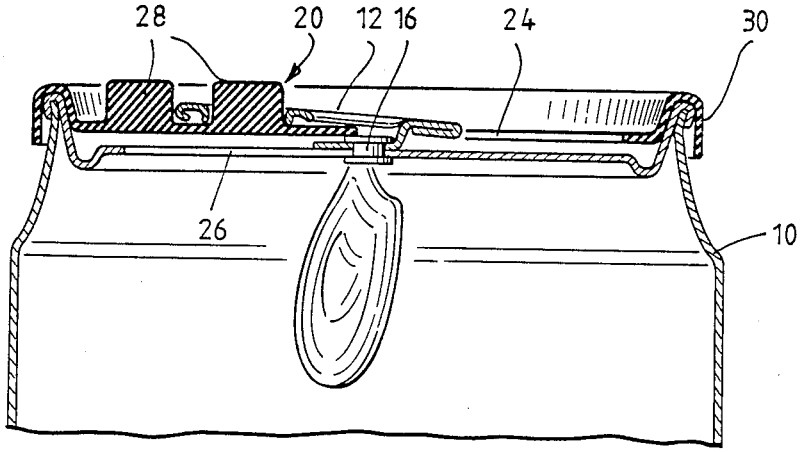
FIG. 5 is a vertical cross-sectional view corresponding to that of FIG. 4 but for a second embodiment of the present invention.

With the lift tab cans as illustrated, the disc 20 may be as a segment of a circle and could be integral with the tab 12. In this way, once the can 10 were opened the tab 12 would be pushed back to as near as possible to its original position and could then be rotated about the rivet 14 to cover and uncover the can opening 26. This would prevent the need for a separate component. In FIG. 5, the disc 20 does not have rib 22. Instead it has a roll-over rim 30 adapted to fit over the rim of can 10. In all other respects, the disc 20 is identical to that of FIGS. 1 to 4.

Figure 6:
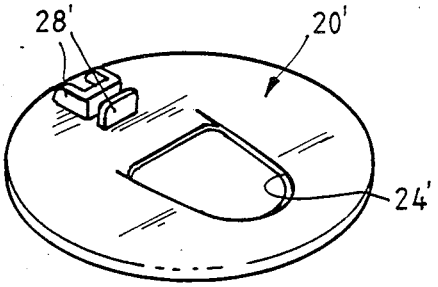
FIG. 6 is a perspective view of a third embodiment of the present invention.

As shown in FIG. 6, the disc 20 may have an opening 24' of different shape, and different lugs 28'. The size and shape of the opening 24 or 24', and the lugs 28 and 28' may be varied to suit the various sizes and shapes of can openings and lift tabs.

Whilst there has been described in the foregoing description preferred constructions of beverage container closures incorporating the preferred features of the present invention, it will be understood by those skilled in the technical field concerned that many variations in details of design and construction may be made without departing from the essential nature of the present invention, the scope of which is to be determined from the following claims.

I claim:

1. A closure for a can, said closure comprising a substantially flat disc adapted to fit on said can and having an opening therethrough, said disc being rotatable about its central axis to align said opening with an opening in said can such that further rotation causes said disc to cover said can opening; said disc having a depending peripheral rib to assist in locating and retaining said disc in position relative to said can, and two lugs projecting axially upwardly therefrom with the location and spacing of said lugs enabling an outer end of a lift tab of said can to be located and held therebetween.

* * * * *